US011097165B2

(12) United States Patent
Zdrazila

(10) Patent No.: US 11,097,165 B2
(45) Date of Patent: Aug. 24, 2021

(54) TENNIS RACKET STRINGING TOOL

(71) Applicant: Vaclav Zdrazila, Las Vegas, NV (US)

(72) Inventor: Vaclav Zdrazila, Las Vegas, NV (US)

( * ) Notice: Subject to any disclaimer, the term of this patent is extended or adjusted under 35 U.S.C. 154(b) by 0 days.

(21) Appl. No.: 16/223,219

(22) Filed: Dec. 18, 2018

(65) Prior Publication Data

US 2019/0344129 A1 Nov. 14, 2019

Related U.S. Application Data

(60) Provisional application No. 62/668,310, filed on May 8, 2018.

(51) Int. Cl.
*A63B 51/14* (2006.01)
*A63B 102/02* (2015.01)

(52) U.S. Cl.
CPC ..... *A63B 51/14* (2013.01); *A63B 2102/02* (2015.10)

(58) Field of Classification Search
CPC ... A63B 51/14; A63B 2051/146; A63B 51/00; A63B 51/16; A63B 2051/143; A63B 2102/02
See application file for complete search history.

(56) References Cited

U.S. PATENT DOCUMENTS 2,156,092 A * 4/1939 Johnson ..... A63B 51/14 139/33
2,268,276 A * 12/1941 Caro ..... A63B 51/14 139/33
3,994,496 A * 11/1976 Burchett ..... A63B 51/14 473/557
4,082,272 A * 4/1978 Garver ..... A63B 51/14 473/557
4,270,752 A * 6/1981 Strelow ..... A63B 51/14 473/557
4,339,131 A * 7/1982 Balaban ..... A63B 51/14 473/557
4,452,452 A * 6/1984 Timmer ..... A63B 51/14 473/557
5,222,998 A * 6/1993 Ferrari ..... A63B 51/14 473/557
10,213,658 B1 * 2/2019 Smith, Jr. ..... A63B 51/16
2019/0344129 A1 * 11/2019 Zdrazila ..... A63B 51/14

FOREIGN PATENT DOCUMENTS

FR 2714840 A1 * 7/1995 ..... A63B 51/14
FR 2785194 A1 * 5/2000 ..... A63B 49/022
WO WO-2013/128375 A1 * 9/2013 ..... A63B 51/14

* cited by examiner

*Primary Examiner* — Raleigh W Chiu

(57) ABSTRACT

A weaving tool for weaving strings in a string bed of a tennis racket is disclosed. The weaving tool has one or more connection bars extending horizontally. Pivotably connected to the connection bars are a plurality of guide bars. The guide bars extend into the string bed of the racket prior to weaving cross strings. The guide bars have perpendicular string channels for receiving the strings in the string bed. The connection bar is moved to the side which moves the strings into an alternating up and down position and allow for a straight space for a cross string to pass through. There are channels in the guide bars which allow a cross string to pass through. There are also string retention members which hold the cross string against the guide bars.

10 Claims, 5 Drawing Sheets

TENNIS RACKET STRINGING TOOL

PRIORITY

This application claims priority to U.S. Provisional Patent Application Ser. No. 62/668,310, filed on May 8, 2018, the disclosure of which is hereby fully incorporated by reference.

FIELD OF THE INVENTION

The invention pertains generally to tools utilized for stringing tennis rackets and more particularly to a tool for assisting the weaving of tennis racket strings.

BACKGROUND OF INVENTION

Rackets with string are utilized in sporting such as tennis or badminton. Rackets are structured with a circular head with a flat bed of woven strings which are substantially perpendicular to one another. To string a racket, a user uses a stringing machine which maintains the tension in the string as the string is fed through holes in the racket head. A user also used string grippers which can be attached to the string bed to maintain the tension. The string grippers are normally attached to the racket stringing machine. There are limitations in these tools however. The string grippers and the racket stringing machine normally hold the tension in the string by keeping the string in a static position. These tools also keep all of the strings in the string bed in a single plane. The user then weaves the cross strings over and under the strings in in the single plane. This is a highly inefficient process as the weaving is time consuming and the user may accidentally miss a string or make other errors during the weaving process. What is needed is a tool which can separate the strings from a planar configuration to a non-planar configuration to increase the speed of weaving.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The invention is directed toward a weaving tool comprising a first connection bar; a plurality of guide bars pivotably attached to said first connection bar; wherein each of said plurality of guide bars comprises a first end and a second end; a right string guide disposed adjacent to said second end and a left string guide adjacent to said second end; wherein said right string guide has a right perpendicular channel configured to receive a first string segment in a racket string bed; and wherein said left string guide has a left perpendicular channel configured to receive a second string segment in a racket string bed and wherein said first string segment and said second string segment are adjacent in said racket string bed.

The plurality of guide bars may further comprise a left channel disposed between said left string guide and said second end of said guide bar; and a right channel disposed between said right string guide and said second end of said guide bar.

The weaving tool may further comprise a plurality of first knobs; wherein each of said plurality of guide bars further comprises a first aperture disposed at said first end; wherein each of said plurality of first knobs is respectively disposed through said first aperture of said plurality of guide bars; and wherein said plurality of first knobs engage said first connection bar.

The weaving tool may further comprise a plurality of string retention members. Each of said plurality of guide bars may further comprise a retainer recess having a diamond-shaped cross section; wherein each of said plurality of string retention members further comprises a diamond-shaped extension; and wherein each of diamond-shaped extensions of said plurality of string retention members is respectively disposed in said retainer recess of said plurality of guide bars. The plurality of string retention members may have a right extension disposed on a lower right edge and a left extension disposed on a lower left edge.

The weaving tool may further comprise a space between said right string guide and a right edge of said string retention member and a space between said left string guide and a left edge of said string retention member.

Each of said plurality of guide bars may further comprise a left channel disposed between said left string guide and said second end of said guide bar; and a right channel disposed between said right string guide and said second end of said guide bar.

The weaving tool may further comprise a second connection bar and wherein said plurality of guide bars are pivotably attached to said second connection bar. Each of said plurality of guide bars may further comprise a second aperture disposed in a middle section of said guide bars.

The weaving tool may further comprise a plurality of second knobs; wherein each of said plurality of second knobs is respectively disposed through said second aperture of said plurality of guide bars; and wherein said plurality of second knobs engage said second connection bar. The first and connection bars may have a central aperture extending a length of said first connection bar.

The invention is also directed to a method of weaving a tennis racket string bed. The comprises threading a plurality of string segments in parallel through a racket head to create a planar string bed; obtaining a weaving tool; ensuring said weaving tool is in a first configuration wherein each of said plurality of guide bars is perpendicular to said connection bar; inserting said weaving tool into said planar string bed by placing said second end of each of said plurality of guide bars into said planar string bed; placing a first string segment in said left perpendicular channel and placing a second string segment in said right perpendicular channel, wherein said first string segment is adjacent to said second string segment; and moving said connection bar in a first direction along a length of said connection bar to place said weaving tool in a second configuration whereby each of said plurality of guide bars are not perpendicular to said connection bar.

The method may further comprise threading a cross string through said string bed. The method may further comprise placing said weaving tool in a second position on said planar string bed; and moving said connection bar in a second direction along a length of said connection bar, wherein said second direction is opposite of said first direction to place said weaving tool in a third configuration whereby each of said plurality of guide bars are not perpendicular to said connection bar.

Still other embodiments of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

Figure 1:
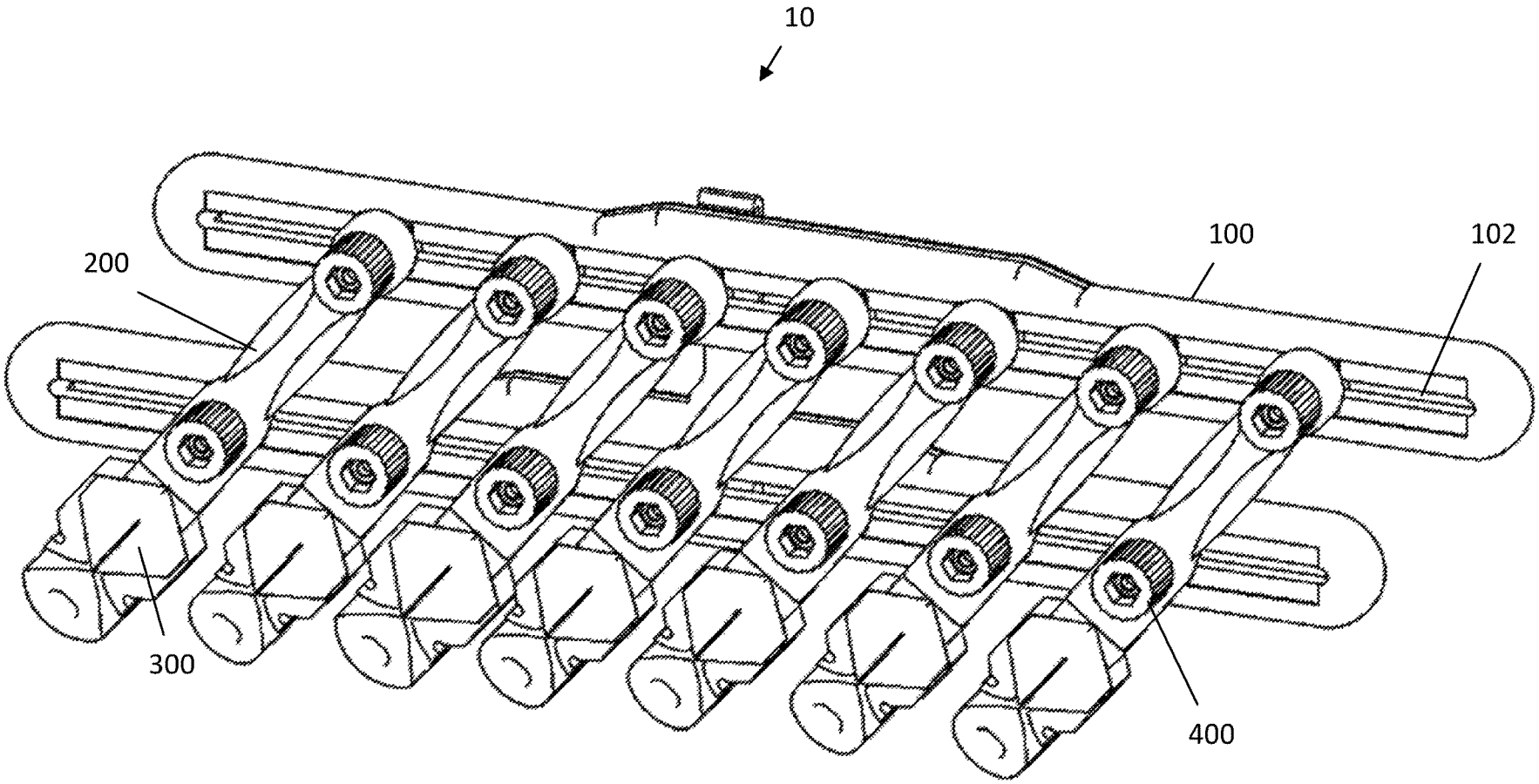
FIG. 1 is a top perspective view of the weaving tool.
Figure 2:
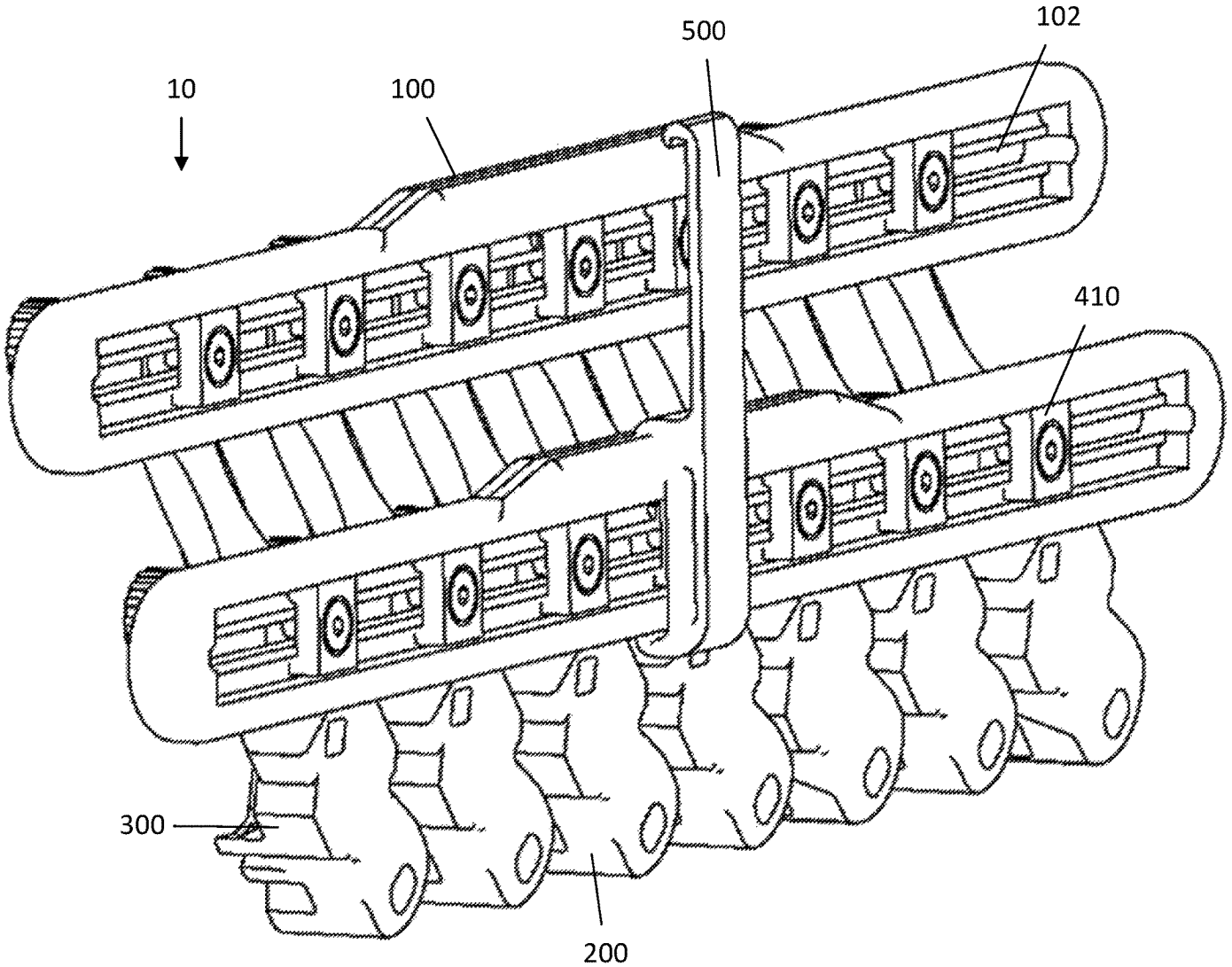
FIG. 2 is a rear perspective view of the weaving tool.
Figure 3:
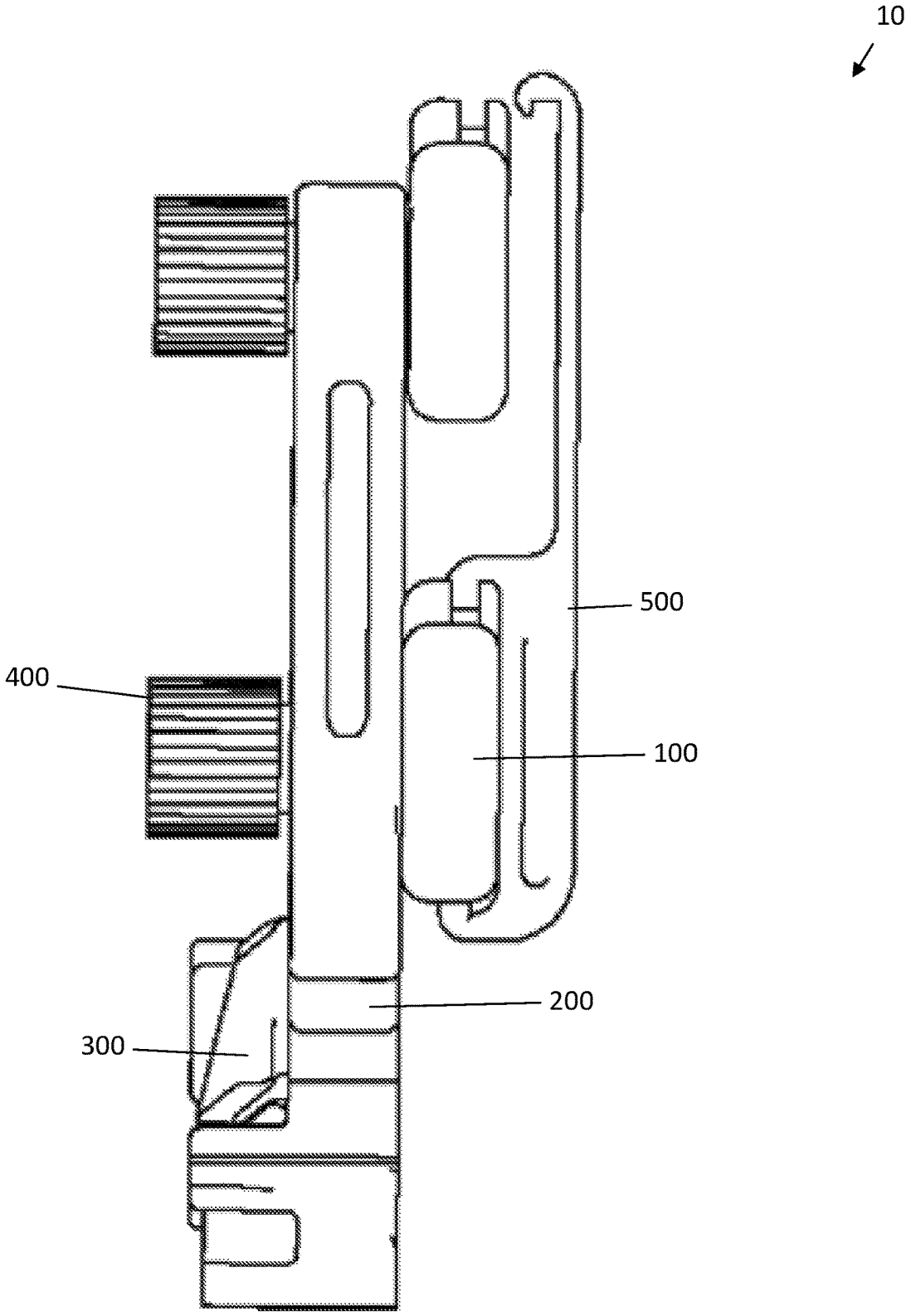
FIG. 3 is a side view of the weaving tool.

The invention is directed toward a weaving tool for use in tennis racket stringing. The weaving tool, however, may be utilized for any purpose where a series of parallel strings are to be woven with a perpendicular set of parallel strings. Referring to FIGS. 1-3, the preferred embodiment of the weaving tool 10 is illustrated. The weaving tool comprises one or more horizontal connection bars 100, one or more guide bars 200 pivotably attached to each connection bar 100, a string retention member 300 disposed on each guide bar 200, and a knob 400 attaching each guide bar 200 to the connection bar 100.

The horizontal connection bar 100 may be any size and shape. In the preferred embodiment the connection bar 100 has a central aperture 102. The central aperture 102 provides a connection point for the guide bars 200. In the preferred embodiment the central aperture 102 is a long rectangular hole by which a user may freely choose the positions of the guide bars 200 by placing each guide bar 200 in a desired position along the central aperture 102. It will be recognized that the position of the guide bars 200 on the connection bar 100 may be adjusted depending on the width of the spaces between the strings in the string bed.

In other embodiments the central aperture 102 may be replaced with a plurality of apertures 102 along the connection bar 100. The plurality of apertures 102 would allow for the placement of the guide bars 200 in predetermined positions. In other embodiments the central aperture 102, or plurality of apertures 102, do not extend through the body of the connection bar 100 but are recesses within the body of the connection bar 100.

The weaving tool 10 may also have a rear hook 500. The rear hook 500 is a connection member utilized to connect the horizontal connection bars 100 together. The bottom end of the rear hook 500 is attached to the lower horizontal connection bar 100. The top end of the rear hook 500 has a curved hook shaped to engage with the upper horizontal connection bar 100. When the guide bars 200 are perpendicular to the horizontal connection bars 100, the top end of the rear hook is disengaged from the upper horizontal connection bar 100. When the guide bars 200 are angled away from perpendicular, the upper horizontal connection bar 100 and the lower horizontal connection bar 100 move closer together. When they move closer together the top end of the rear hook 500 engages the upper horizontal connection bar 100 and locks the weaving tool in place in the angled configuration. A user may then disengage the rear hook 500 from the upper horizontal connection bar 100 by pressing down on the upper horizontal connection bar 100.

Figure 4:
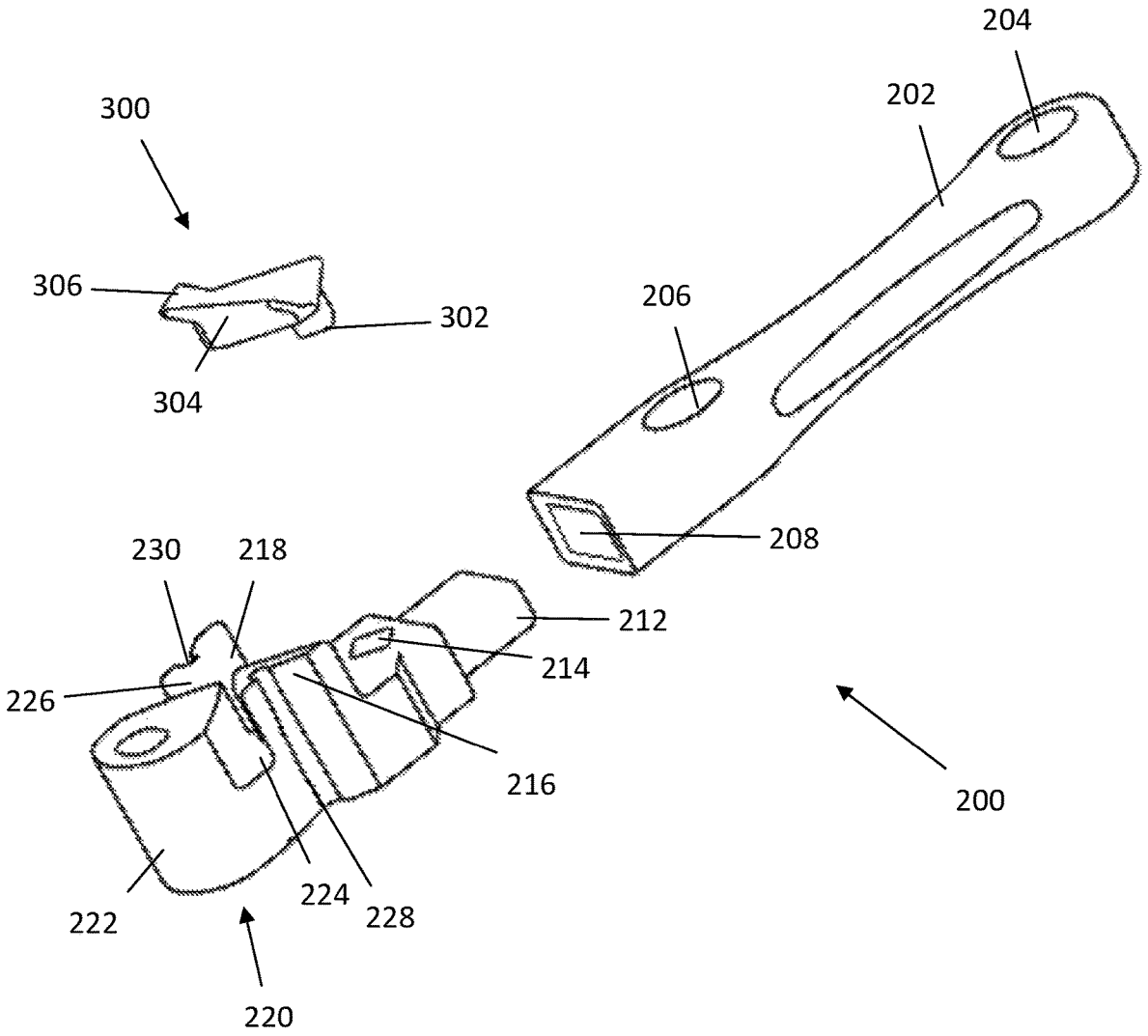
FIG. 4 is an exploded view of a guide bar from the weaving tool.

Referring to FIG. 4, an exploded view of the guide bar 200 is illustrated. In the preferred embodiment the guide bar 200 comprises a top portion 210 and a lower portion 220. In other embodiments the top portion 210 and lower portion 220 may be fused together into a single body. The top portion 210 connects to the connection bar 100. The top portion 210 has a first aperture 204 and a second aperture 206. The first aperture 204 is disposed at the top end of the top portion 210. The second aperture 206 is disposed toward the central or lower end of the top portion 210. There may be any number of apertures in the top portion 210. The apertures may be of any size and shape. The apertures allow for knobs 400 to be placed through the apertures so that additional connection bars 100 may be connected to the guide bars 200. The top portion 210 has a bottom recess 208. The bottom recess 208 permits the lower portion 220 to be attached to the top portion 210. The lower portion 220 has a top extension 212 which inserts into the bottom recess 208. In the preferred embodiment the top extension 212 stays within the bottom recess 208 by the force of friction. In other embodiments, screws, latches, hooks, or other securing members may be used to removably secure the lower portion 220 to the top portion 210.

The lower portion 220 may be any shape and size. In the preferred embodiment, different sizes of lower portions 220 may be utilized. The different sizes permit the weaving tool 10 to be used with different racket and string patterns. In this manner a user can remove and replace the lower portions 220 to string a different racket without completely disassembling the weaving tool 10. The lower portion 220 has a retainer aperture 214. The retainer aperture 214 may be any size and shape. The retainer aperture 214 may extend through the body of the lower portion 220 or may be a recess into the body of the lower portion 220. The retainer aperture 214 provides a connection point for the string retention member 300 to be removably secured to the guide bar 200. In the preferred embodiment the retainer aperture 214 is diamond shaped. The string retention member 300 has a string guide extension 302 which is dispose within the retainer aperture 214. The string guide extension 302 may be any size and shape. The string guide extension 302 extends perpendicularly from the body of the string retention member 300. In the preferred embodiment the string guide extension 302 is diamond shaped and fits within the retainer aperture 214. In other embodiments the string retention member 300 is attached and a part of the entire body of the guide bar 200.

The lower portion 220 has a right string guide 216 and a left string guide 218. The right string guide 216 and the left string guide 218 extend at upward angles from the center of the guide bar 200 to the outer sides of the guide bar 200. At the bottom end of the guide bar 200 is a bottom end 222. The bottom end 222 may be any size and shape. The bottom end 222 may have another aperture for the attachment of another connection bar 100. The bottom end 222 is configured to be placed between parallel strings in a string bed and extend below the string bed. Between the right string guide 216 and the bottom end 222 is a right channel 224. Between the left string guide 218 and the bottom end 222 is a left channel 226. The right channel 224 and the left channel 226 may be any size and shape but are preferably sufficiently shaped to receive a racket string.

The right string guide 216 has a right perpendicular channel 228. The left string guide has a left perpendicular channel 230. When the bottom end 222 is disposed through and below the string bed, a pair of parallel strings are disposed in the right perpendicular channel 228 and the left perpendicular channel 230.

The string retention member 300 may be any size and shape. In the preferred embodiment the string guide is diamond shaped. The string retention member 300 has a V-shaped lower end formed by a right extension 304 and a left extension 306. The right extension 304 and the left extension 306 may be any size and shape. The right extension 304 and left extension 306 hold the string against the left string guide 218 and right string guide 216 during the stringing process to prevent it from accidentally being removed. In the preferred embodiment the right extension 304 and left extension 306 are outwardly flexible, permitting the user to remove the string by pulling outward.

The knobs 400 may be any size and shape. The knobs 400 preferably have a threaded end which extend through the first aperture 204, through the central aperture 102 of the connection bar 100, and into the knob screws 410 disposed on the rear side of the connection bar 100. The knobs 400 secure the guide bars 200 to the connection bar 100 but permit the guide bars 200 to pivotably rotate about the knob 400. In other embodiments the knobs may screw directly into the connection bar 100 without the knob screws 410. In other embodiments the knob screws 410 are attached to the connection bar 100 in a fixed position. In another embodiment the knob screws 410 are attached to the connection bar 100 but may slide horizontally along a channel extending the length of the connection bar 100.

Figure 5:
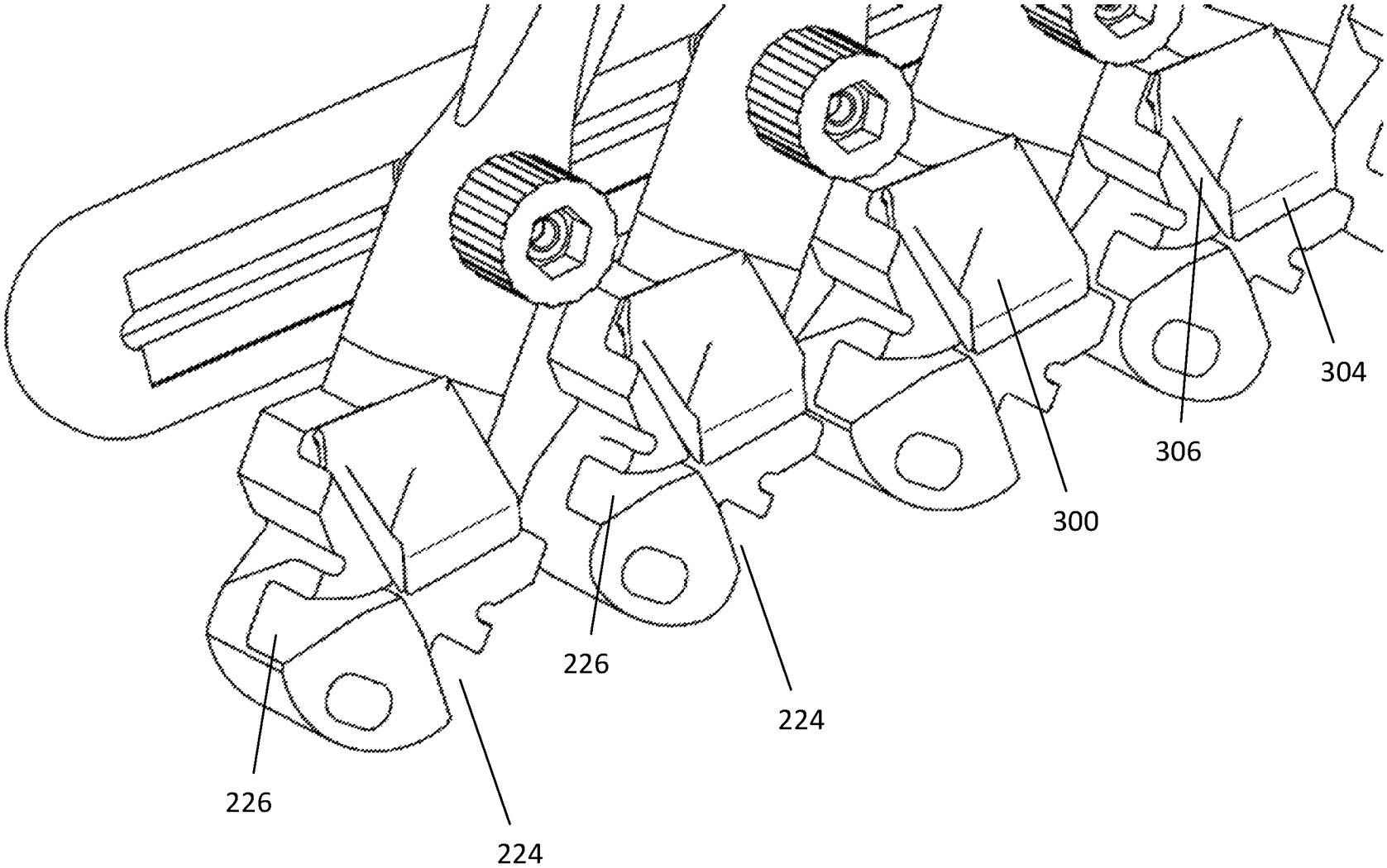
FIG. 5 is an enhanced view of the lower end of the guide bars.

Referring to FIG. 5, the use of the weaving tool 10 is best illustrated. When a set of parallel strings are first placed within the racket head, a user must then weave in a cross string. At this point in time the user placed the weaving tool 10 through the parallel strings. The weaving tool is disposed in a first configuration where the guide bars 200 are perpendicular to the connection bar 100. Each guide bar 200 is disposed through a pair of parallel strings. The guide bars 200 are disposed through alternating spaces between the strings. The parallel strings are disposed in the right perpendicular channel 228 and left perpendicular channel 230 of each guide bar. The user then moves the connection bar 100 to the side such that the guide bars 200 are pivoted to a position that they engage the connection bar 100 at an angle which is not perpendicular. When the guide bars 200 are tilted at an angle, as shown in FIG. 3, the right perpendicular channel 228 forces the string disposed within it downward below the plane of the string bed. At the same time the left perpendicular channel 230 pushes the string disposed in it upward above the plane of the string bed. In this manner the strings in the string bed are forced alternatingly above and below the plane of the string bed. This permits an opening between the strings for a cross string to be threaded.

As shown in FIG. 5, when placed at an angled position, the user can thread the cross string through the left channel 226 of each guide bar 200. The cross string also is threaded through the space between the right string guide 216 and the right extension 304 of the string retention member 300. The cross string is threaded the entire string bed and is threaded through the hole in the end of the racket. The user then threads the cross string back in the opposite direction through the string bed. The user slides the guide bars then into the new position to receive the cross string. The user then slides the connection bar 100 to the opposite angle so that the right perpendicular channel 228 pushes a string above the plane of the string bed and the left perpendicular channel 230 pushes a string below the plane of the string bed. The user then threads the cross string through the right channel 224 and the space between the left string guide 218 and the left extension 306 of the string retention member 300. The user repeats this process until the entire set of cross strings are threaded through the string bed.

The weaving tool 10 may be utilized with other components to improve the usage of the weaving tool 10. For instance, the weaving tool may include a lock which locks the knobs 400 into a desired position to prevent the rotation of the guide bars 200. The weaving tool may also include one or more springs disposed on the knobs 400 which force the guide bars 200 to return to a perpendicular position in relation to the connection bar 100 after the cross string has been threaded through.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

What is claimed is:

1. A weaving tool comprising
a) a first connection bar;
b) a plurality of guide bars pivotably attached to said first connection bar;
c) wherein each of said plurality of guide bars comprises
i) a first end and a second end;
ii) a right string guide disposed adjacent to said second end and a left string guide adjacent to said second end;
(1) wherein said right string guide has a right perpendicular channel configured to receive a first string segment in a racket string bed;
(2) wherein said left string guide has a left perpendicular channel configured to receive a second string segment in a racket string bed and wherein said first string segment and said second string segment are adjacent in said racket string bed; and
d) wherein each of said plurality of guide bars further comprises
a) a left channel disposed between said left string guide and said second end of said guide bar; and
b) a right channel disposed between said right string guide and said second end of said guide bar.

2. The weaving tool as in claim 1
a) wherein each of said plurality of guide bars further comprises a retainer recess having a diamond-shaped cross section;
b) further comprising a plurality of string retention members and wherein each of said plurality of string retention members further comprises a diamond shaped extension, and
c) wherein each of diamond-shaped extensions of said plurality of string retention members is respectively disposed in said retainer recess of said plurality of guide bars.

3. The weaving tool as in claim 2 wherein each of said plurality of string retention members has a right extension disposed on a lower right edge and a left extension disposed on a lower left edge.

4. The weaving tool as in claim 3 wherein each of said plurality of guide bars further comprises
a) a left channel disposed between said left string guide and said second end of said guide bar; and
b) a right channel disposed between said right string guide and said second end of said guide bar.

5. The weaving tool as in claim 4 further comprising
a) a plurality of first knobs;
b) wherein each of said plurality of guide bars further comprises a first aperture disposed at said first end;
c) wherein each of said plurality of first knobs is respectively disposed through said first aperture of said plurality of guide bars; and
d) wherein said plurality of first knobs engage said first connection bar.

6. The weaving tool as in claim 5 further comprising a second connection bar and wherein said plurality of guide bars are pivotably attached to said second connection bar.

7. The weaving tool as in claim 6 wherein each of said plurality of guide bars further comprises a second aperture disposed in a middle section of said guide bars.

8. The weaving tool as in claim 7 further comprising
a) a plurality of second knobs;
b) wherein each of said plurality of second knobs is respectively disposed through said second aperture of said plurality of guide bars; and
c) wherein said plurality of second knobs engage said second connection bar.

9. The weaving tool as in claim 8 wherein said first connection bar further comprises a central aperture extending a length of said first connection bar.

10. A weaving tool comprising
a) a first connection bar;
b) a plurality of guide bars pivotably attached to said first connection bar;
c) wherein each of said plurality of guide bars comprises
i) a first end and a second end;
ii) a right string guide disposed adjacent to said second end and a left string guide adjacent to said second end:
(1) wherein said right string guide has a right perpendicular channel configured to receive a first string segment in a racket string bed;
(2) wherein said left string guide has a left perpendicular channel configured to receive a second string segment in a racket string bed and wherein said first string segment and said second string segment are adjacent in said racket string bed; and
d) wherein said first connection bar further comprises a central aperture extending a length of said first connection bar.

* * * * *